US010473437B2

(12) United States Patent
Adrain

(10) Patent No.: US 10,473,437 B2
(45) **Date of Patent: *Nov. 12, 2019**

(54) BULLET PROOF BLINDS

(71) Applicant: John B. Adrain, Frisco, TX (US)

(72) Inventor: John B. Adrain, Frisco, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/476,206

(22) Filed: Sep. 3, 2014

(65) Prior Publication Data

US 2015/0059990 A1 Mar. 5, 2015

Related U.S. Application Data

(60) Provisional application No. 61/873,073, filed on Sep. 3, 2013.

(51) Int. Cl.

| | |
|---|---|
| ***F41H 5/26*** | (2006.01) |
| ***E06B 9/56*** | (2006.01) |
| ***F41H 5/04*** | (2006.01) |
| ***F41H 5/02*** | (2006.01) |
| ***E06B 9/264*** | (2006.01) |
| ***E06B 9/32*** | (2006.01) |
| ***E06B 9/386*** | (2006.01) |
| ***E06B 9/40*** | (2006.01) |
| ***E06B 9/68*** | (2006.01) |
| *A62C 2/14* | (2006.01) |

(52) U.S. Cl.

CPC ..... *F41H 5/26* (2013.01); *E06B 9/264* (2013.01); *E06B 9/32* (2013.01); *E06B 9/386* (2013.01); *E06B 9/40* (2013.01); *E06B 9/56* (2013.01); *E06B 9/68* (2013.01); *F41H 5/026* (2013.01); *F41H 5/0457* (2013.01); *A62C 2/14* (2013.01); *E06B 2009/6818* (2013.01)

(58) Field of Classification Search

CPC ..... F41H 5/26; F41H 5/007

See application file for complete search history.

(56) References Cited

U.S. PATENT DOCUMENTS

| | | | | |
|---|---|---|---|---|
| 2,149,481 A * | 3/1939 | Van Bosch | E05F 15/71 160/168.1 P |
| 2,366,514 A | 1/1945 | Gaylor | |
| 4,588,223 A * | 5/1986 | Ledenyi | B60R 21/12 160/84.06 |
| 5,188,161 A * | 2/1993 | Erber | E06B 9/34 160/133 |
| 5,802,783 A | 9/1998 | Bayha | |
| 5,907,929 A | 6/1999 | Poma et al. | |
| 6,044,889 A | 4/2000 | Liu | |

(Continued)

OTHER PUBLICATIONS http://blog.modernmechanix.com/venetian-blinds-of-steel/; Modern Mechanix; Venetian Blinds of Steel (Oct. 1937).

*Primary Examiner* — Hongmin Fan

(74) *Attorney, Agent, or Firm* — Bodi Law LLC

(57) ABSTRACT

A blind system comprising a plurality of slats having a ballistic resistant material; a control system operably configured to cause a change in state of the blind from an open state to a protective closed state; and a sensing system operably configured to detect a threatening event, wherein the sensing system upon sensing the threatening event triggers the control system to transition from the open state to the protective state such that in the protective state, the blinds are adapted to be resistant to penetration by high-speed ballistic objects

26 Claims, 4 Drawing Sheets

(56) References Cited

U.S. PATENT DOCUMENTS 6,212,840 B1 4/2001 Davidovitz
6,296,039 B1 * 10/2001 Mullet ..... E06B 9/40 160/264
6,298,766 B1 10/2001 Mor
6,338,377 B1 1/2002 Domel
6,494,000 B1 12/2002 Emek
6,536,174 B2 3/2003 Foster et al.
6,604,322 B2 8/2003 Horn et al.
6,607,693 B1 8/2003 Saito et al.
6,648,048 B2 11/2003 Lai
6,796,360 B2 9/2004 Ferrie et al.
6,862,970 B2 3/2005 Aghajanian et al.
7,036,279 B2 5/2006 Crozzoli
7,694,482 B2 4/2010 Gazaway et al.
8,322,268 B1 12/2012 Booher, Sr.
8,365,803 B2 2/2013 Schoenheit et al.
9,134,097 B1 * 9/2015 De Gaglia ..... F41H 5/24
2004/0025453 A1 2/2004 Coddens
2005/0144900 A1 7/2005 Hallissy et al.
2006/0032160 A1 2/2006 Gazaway et al.
2009/0071604 A1 * 3/2009 Moeyersons ..... B32B 17/10018 156/285
2009/0308543 A1 12/2009 Kates
2010/0043292 A1 * 2/2010 Wilkins ..... E06B 5/12 49/64
2010/0164743 A1 * 7/2010 Domel ..... G08C 19/28 340/12.1
2012/0325127 A1 * 12/2012 Adrain ..... G08B 15/02 109/31
2013/0019742 A1 1/2013 Lecarpentier et al.
2013/0062024 A1 * 3/2013 Huang ..... E06B 9/50 160/127
2013/0146236 A1 6/2013 Chen
2013/0222130 A1 8/2013 Cooper et al.
2014/0163751 A1 6/2014 Davis et al.
2014/0224108 A1 8/2014 Sundberg et al.
2015/0000825 A1 * 1/2015 Crook ..... C08K 5/098 156/109
2015/0059990 A1 3/2015 Adrain
2015/0225996 A1 * 8/2015 Maksan ..... E06B 9/327 160/107
2016/0143486 A1 5/2016 Tsibulevskiy et al.

* cited by examiner

BULLET PROOF BLINDS

This application claims the benefit of U.S. Provisional Application No. 61/873,073, filed Sep. 3, 2013, and incorporated herein by reference in its entirety.

BACKGROUND

Technical Field

This application relates generally to a window blind system with ballistic panels to be used for window, door or other suitable coverings.

Description of Related Art

Window blinds, such as venetian blinds, and vertical blinds have found widespread use in residential and commercial applications as window coverings because of their ability to selectively vary the amount of light passing through a window, glass door, skylight, or the like, by the varying of a plurality of vanes, louvers or slats.

Current ballastic systems in residential and commercial applications such as armored doors and windows are usually made of metal or a material containing at least one metal plate, and thus having an extremely high weight. Some plastic systems exist that have lower weight, but that are very flimsy and weak, and thus would provide no protection from projectiles or other forced entry into the dwelling.

It would be useful to utilize the widespread use of window blinds to provide unauthorized entry protection to individuals and organizations in residential, commercial, government, federal building and mobile or any suitable application.

SUMMARY

The following presents a simplified summary in order to provide a basic understanding of some example aspects described in the detailed description.

In one aspect, an a blind system is disclosed herein including a control system operably configured to cause a change in state of the blind from an open state to a protective state; and a sensing system operably configured to detect a threatening event, in which the sensing system upon sensing the threatening event triggers the control system to transition to the protective state.

In another aspect, a blind system is disclosed herein including a plurality of slats having a ballistic resistant material; a control system operably configured to cause a change in state of the blind from an open state to a protective closed state; and a sensing system operably configured to detect a threatening event, wherein the sensing system upon sensing the threatening event triggers the control system to transition from the open state to the protective state such that in the protective state, the blinds are adapted to be resistant to penetration by high-speed ballistic objects.

In yet another aspect, a blind system is disclosed herein including a blind suspended from a rail and a blind adjustment system that is configured to transition the blinds from an open state to a closed, protective state in which the blinds are adapted to be resistant to penetration by high-speed ballistic objects.

The blinds provides an anti-entry function, such as a bullet proof system characterized by light weight, high ballistic resistant vanes, louvers or slats for application in a simple, yet unconventional manner.

This summary is not an extensive overview of the features and systems discussed herein. It is not intended to identify key/critical elements or to delineate the scope of such features and systems. Its sole purpose is to present some concepts in a simplified form as a prelude to the more detailed description.

BRIEF DESCRIPTION OF THE DRAWINGS

The foregoing and other features and advantages will become apparent to those skilled in the art to which the present invention relates upon reading the following description with reference to the accompanying drawings, wherein.

DETAILED DESCRIPTION OF THE PREFERRED EMBODIMENTS

Figure 1:
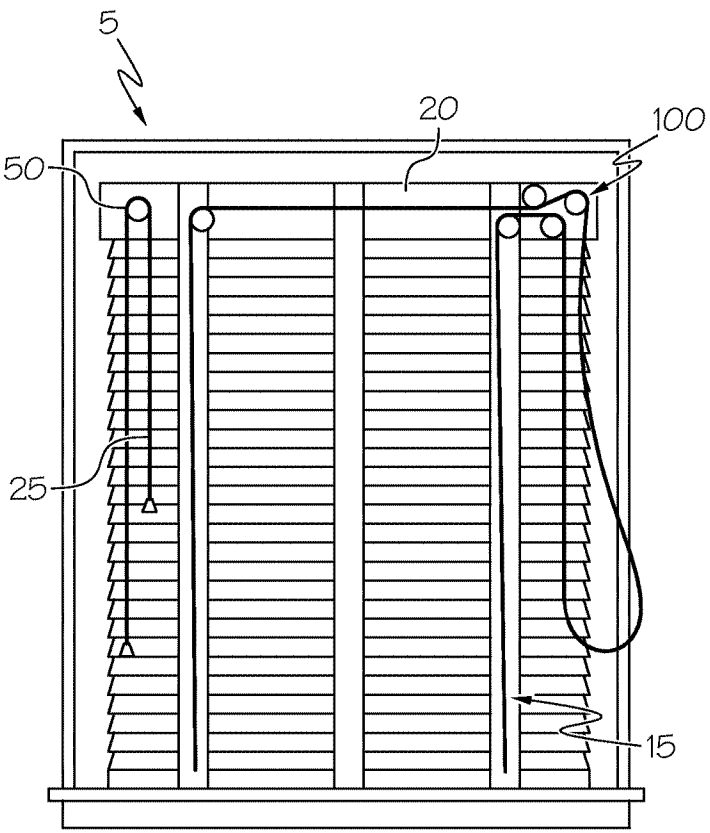
FIG. 1 illustrates a front view of one example embodiment of a venetian blind system.

Referring to FIG. 1, an example embodiment of a blind system is shown. The blind system 5 includes a plurality of members such as vanes, louvers or slats 10 resting or hanging on the rungs of one or more ladders 15, which are movably suspended from a head, bottom or side rail 20, which may be mounted to a window or door frame. The vanes, louvers or slats 10 could be of horizontal or vertical orientation.

The slats 10 can be of conventional construction, and can be constructed of a number of different materials, including, but not limited to, the following materials: plastic, composites, wood, metal, fabric, fiberglass or any other suitable ballistic material including, but not limited to, Kevlar or Lexan or DuPont™ Tensylon®, for example. In an example embodiment, the slats could also be provided as a laminate, such as steel with a carbon fiber or tensylon or fiber glass backing. Also, fabric can be treated with boron to form a ballistic resitent material. For example, a fabric can be dipped into a boron solution, then heated in an oven at more than 1000C, which changes cotton fibers in the fabric into carbon fibers, such that the carbon fibers react with the boron solution to produce boron carbide.

Figure 2:
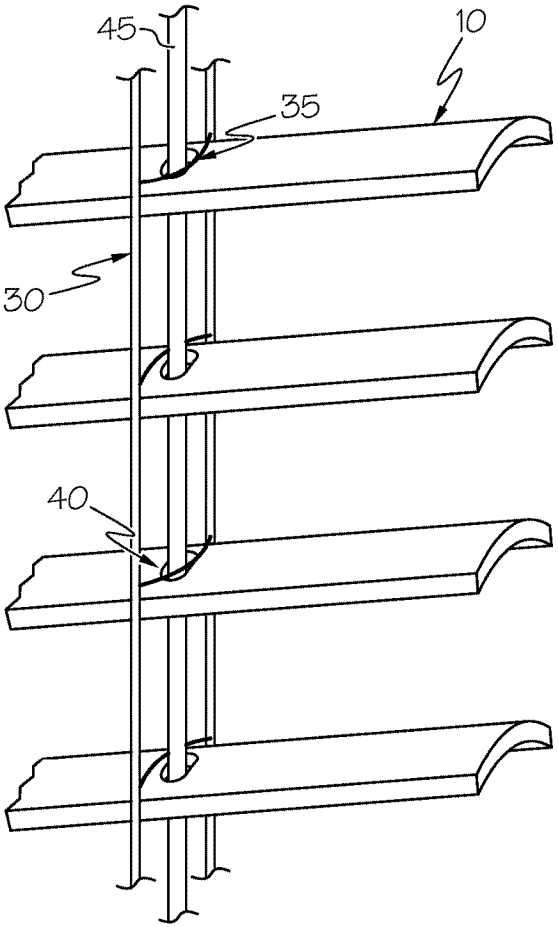
FIG. 2 illustrates a detailed perspective view of an example embodiment of the blind system.
Figure 3:
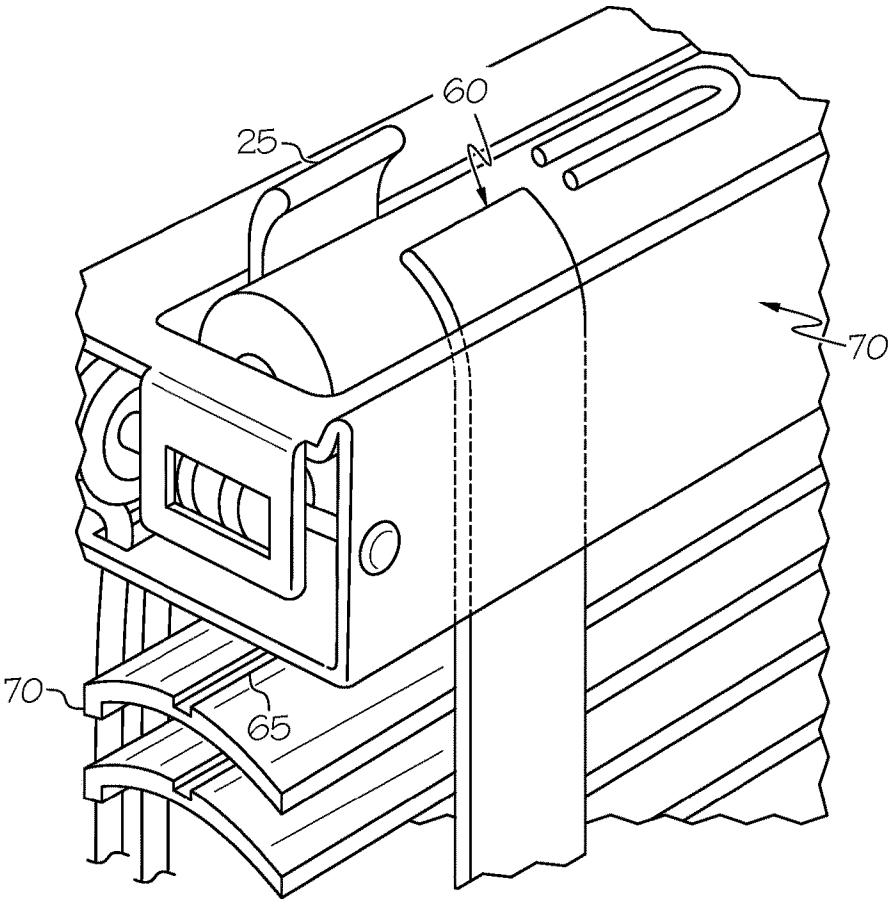
FIG. 3 illustrates a detail view of a head box portion an example embodiment blind system.

The slats 10 could vary in shape, width and thickness to form blinds of various styles and construction, as desired. The slats may have a uniform thickness as shown in FIGS. 2 and 3. The slats 10 can be made flat or curved across their transverse dimension, they can be of any desired width, and they could be provided of different dimensions, such as, for example one, two, three, or four inches wide or any other suitable width for the desired application. The lengths of the slats can be varied according to the window or door size that they are being utilized to protect, and they could be of a length of a foot or more, up to 4 to 7 feet or more, as desired.

Turning to the operation of the blind system 5, the slats 10 can be tilted by a tilt mechanism 50 to let in partial light, such as when a tilt wand or cord 25 is used to adjust the slats 10. The slats 10 can also be lifted or collapsed by a lift mechanism 100 (for example, to fold or accordion the slats into a compact position) to let in full or nearly full light, for example.

Referring to the example embodiment of FIG. 2, the slats 10 are suspended by the ladder 15 which is comprised of at least two strips of cloth or string or tape 30 that allows the slats 10 to be suspended in a manner such that all slats 10 in unison can be rotated nearly 180 degrees, such as to go from an open condition (state) to a closed (protective) condition (state). The tape 30 can be made of any flexible material such as fabric, plastic, nylon, polyester, or any flexible material or the like. The ladder 15 further comprises a connector tape 35 which connect the two strips of tape 30 together. Rotating the tilt-cord 25 causes the slats 10 to rotate/tilt a longitudinal axis in order to open or close visual access to the outside from inside the room in which the blinds are installed.

As an alternative to rotation, in some embodiments the slats may be opened and closed by sliding the slats or collapsing the slats together, for example.

The slats 10 of the blind system 5 further comprise routed through rout holes 40. Each slats 10 comprises at least one rout hole 40. At least one steel rod 45 which is affixed to the head or bottom rail 20 runs through each slat 10. The slats 10 could pivot about the steel rod 45 which is encased in the slats 10. Pulling the lift-cord activates the lift mechanism 100 causing either the bottom rail or the top rail to rise, sequentially collecting the slats from the bottom up or the top down and compressing the entire array of slats 10 against the top-rail.

Turning to FIG. 3, the blind system 5 may include a rotator member, or tube 60 provided for rotation of the rotator 60 within an axis provided in the head box 70. The tilt cord 25 is fixedly attached to the rotator 60 and hangs downwardly from the head box.

In an example embodiment, the slats 10 may have a groove 65 and and/or tongue 70 that may run the length of the slats 10. While the embodiment shows the groove runs the length of the slat, it is appreciated that a groove-tongue system located at the edge of the slat 10 may suffice. The groove 65 and tongue 70 allows slats 10 to interlock when they are in a closed position for additional strength. In another example embodiment, the slats 10 can have fasteners that allow them interlock for additional strength. The fasteners could engage with the window or door sill for added strength, if desired.

Figure 4:
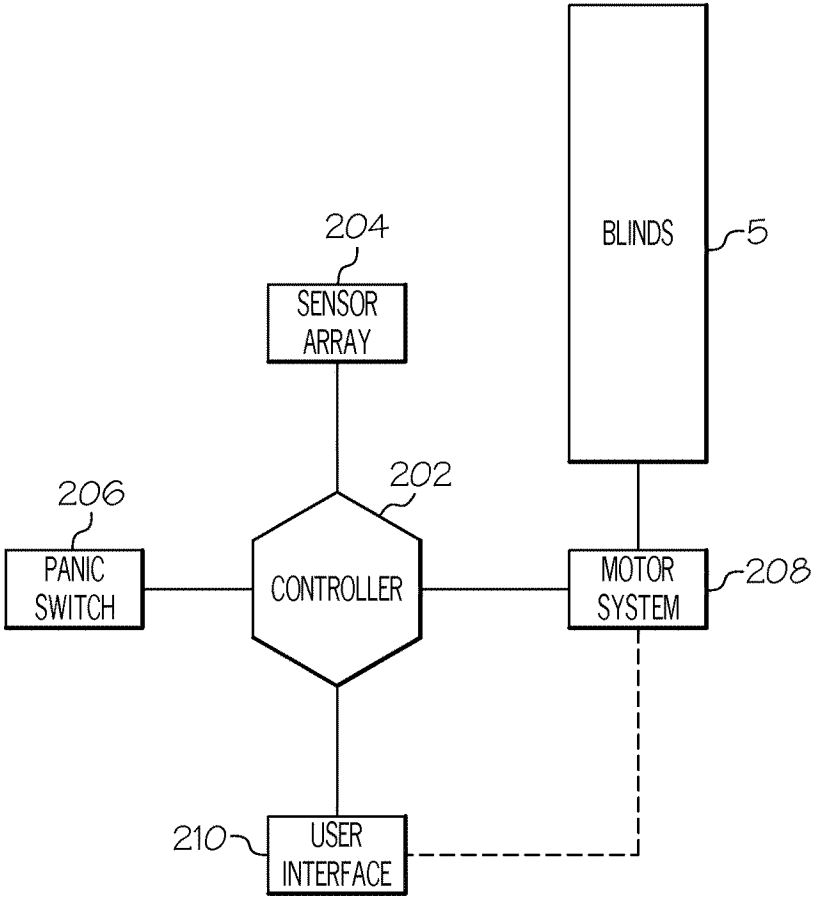
FIG. 4 illustrates an example control method for the blind system

FIG. 4. Illustrates an example of a control system which may be used by any of the embodiments described herein to control the blind system 5. The control system can include a controller 202 with one or more sensors that form a sensor array 204 connected to the controller 202, and a panic switch 206 connected to the controller 202. The sensors may be pre-existing sensors in a home defense system or conventional after-market sensors capable of detecting ballistic signals such as sound, gun powder, gun impact, muzzle flash, temperature, and the like. The controller 202 is connected to a user interface 210 whereby a user may activate and apply settings to the blind system. The controller 202 is also connected to a motor system 208 for actuating the blind system upon receiving information indicating that a threat is present and that the blinds should be closed (i.e., put into a protective state such as a ballistic protection mode).

Where a building may already have a central control system, controller 202 may utilize such a system by adding additional customized code for operating the blinds system 5. In another example, the blinds could also utilize ground sourced radar, infrared (heat), sonar, or some other active or passive detection system. The sensor array 204 can include one or more heat sensors, infrared sensors, video sensors, audio sensors, smoke detectors, or other types of sensors, or may utilize already existing sensors of a fire or burglar system, for example. Any of the sensors in the sensor array 204, the panic switch 206 or the user interface 210, or any combination of these components, may be connected to the controller 202 in a wireless manner, such as by WiFi or Bluetooth, for example, and the panic switch and/or user interface could be implemented on a cell phone or tablet computer, for example.

The system may be controlled by any external or internal system. For example, the blind system could be tied to an external system such as an alarm system or video cameras with analytics. The blind system could also be controlled remotely via the internet or a WiFi or Bluetooth connection by any connected device such as a tablet, computer, PDA, or a smartphone. Blinds such as disclosed herein would be very useful in a panic situation in a school or federal building. Such blinds could also be used in a lock down situation to prevent people or valuables from leaving the premises, for example.

The blinds could also be adapted to sense the location of the occupants of the building and close by according to predetermined parameters such as direction of threat and the location inside the building that would be the best to return fire from. Blinds could also be controlled by facial recognition, video analytics, or by the occupants' voice or any other suitable biometrics, such as for recognizing an threatening person, such as an ex-spouse, or ex-employee who has made threats or acted in a threatening manner, or otherwise recognizing a wanted criminal or an enemy soldier, for example. When the blind system 5 is activated, the slats 10 overlap each other to form the interlocking pattern discussed above so as deflect bullets, shells, or other ballistic weapons to prevent a fatal impact and/or property damage. Such blinds can protect from thrown objects as well, such as rocks, grenades, bricks, molotov cocktails, etc. Blinds could be controlled individually or together with a timing mechanism.

As an example use, the blind system may be provided in an open state where the blinds are provided in an open condition (e.g., with open slats) to allow viewing through the blinds. The blind system sensor array would detect a potential intruder or the sound of gunfire using visual, auditory, or other sensed information. The system would then automatically enter a protective state, such as by closing the blinds (e.g., closing the slats) to protect the interior of the room from external entry of projectiles (e.g., bullets), for example. Or the system may detect the entry of a ballistic projectile (e.g., a bullet, rock, etc.), or threatening shouts or yells, sirens, explosions, proximity of threatening individuals, etc. in which case the blinds would be activated into a protective mode.

Figure 5:
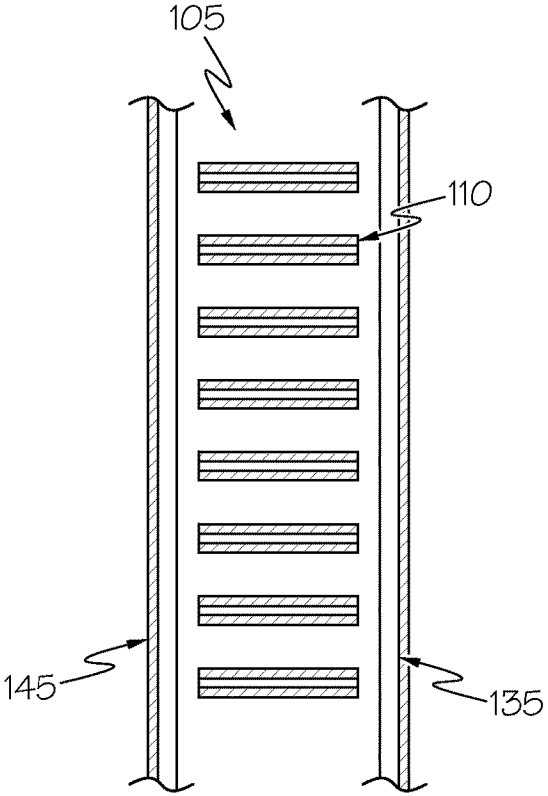
FIG. 5 illustrates an alternative example embodiment of a side view of the blind system.

In an alternate example embodiment illustrated in FIG. 5, the blind system 105 can reside between two glass panes, such as safety glass panes 135 for use in applications like automobiles, airplanes, boats or other mobile applications. The blind system 135 may also be used in stationary applications like residential and commercial applications. The safety glass panes can be made of any lightweight glass material which is useful in an armored car to reduce weight of the glass used which improves the fuel efficiency of the vehicle.

In an example embodiment, the slats 110 used between the safety glass panes 135 could be a composite or laminate, such as fabric with a carbon fiber or tensylon or fiber glass backing or other ballistic resilient backing.

In an example embodiment, the glass panes 135 could have a layer of safety film 140 such as, for example, Cellulose acetate film, 3M safety film, Armor guard films or the like for additional protection. The safety film can be between 4 mil to 10 mil, for example, although other thicknesses could be used. In another example embodiment, the glass panes 135 could be made of fire glass with a gel center such as manufactured by SAFTI First, for example.

In an automobile application the blind system 105 could be controlled with safety in mind so that a driver does not lose all drivability at once and improving the ability to evade. For example, the blinds could have a small port hole for the driver of the vehicle to see out of to allow the driver to continue to drive toward a safer area, for example.

In use for mobile applications, such as in boats, or airplanes or automobile, the blind system 105 could be configured to tilt or close the blinds based on temperature, sound, threat, geographic terrain, environmental conditions and any outer suitable factors. For example, as a vehicle goes up a hill, the blinds can be adapted to tilt so that air can get in and not bullets.

The blind system 105 could also be fire rated to prevent fire from spreading to the next room or structure through the use of fire retardant or preventive materials, where the blinds can be automatically closed when a fire is detected through monitoring of temperature, light, or infrared, for example.

Figure 6:
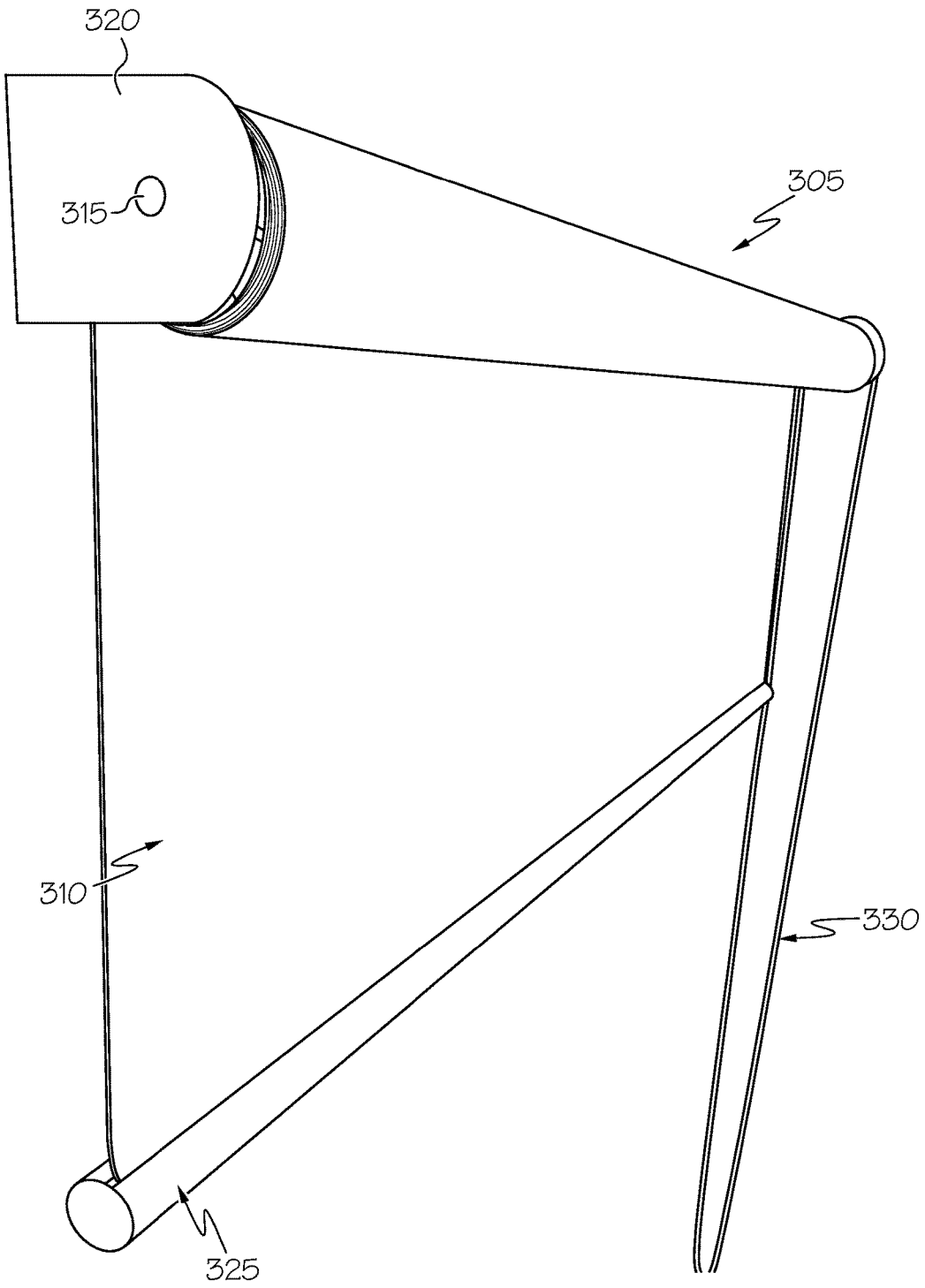
FIG. 6 illustrates an alternative example embodiment of a perspective view of the blind system

In another example embodiment illustrated in FIG. 6, the blind system 305 may have a roll up blind configuration that may utilize an anti-ballistic fabric material 310, for example, and that can be used as protective covering to protect equipment such as, for example, a radiator, or a ventilation system, or on an intake area of a jet engine, engine, radiator, or gas tank of an automobile (or other vehicle), or any other suitable protective covering applications. The roll-up blind system 305 may be made of bullet resistant fabric such as Kevlar or Lexan or DuPont™ Tensylon®.

In an alternate example embodiment, the roll up blind system 305 can reside between two glass panes, such as safety glass panes 135 for use in applications like automobiles, airplanes, boats or other mobile applications.

The fabric blind 310 could also tilt or otherwise be operated according to the threat or terrain. The fabric blind 310 could close from the top or bottom depending on the design of the building or application. The fabric blind 310 could also run left to right, for example. The blinds could also tilt according to the threat or terrain. For example with vehicle application when the blind is used as a radiator cover, as the vehicle goes up a hill the radiator blinds tilt so air can get in and not bullets.

In an alternate example embodiment, the roll up blind system 305 may be used for windows, doors, entryways, or any other desired application. The roll up blind system 305 could suspend from a rail 315 that may be disposed within a head box 320 and may be weighed down by bottom rail 325 to maintain its position. The weight of the bottom rail can vary to match the desired application. A reel cord 330 may be used to be roll up the blinds 310 or to roll down the blind 310. The reel cord 330 may also be pneumatically or automatically driven. The lengths of the blind 310 can be varied according to the window or door size that they are being utilized to protect, and they could be of a length for the desired application.

Generally, any of the blind systems provided herein will typically be provided with blinds that can be placed in an open state at the request of a user to enable viewing through the blinds, and/or to allow for airflow and/or other flow through the blinds. Such blinds can also be closed at the request of a user, in which case the blinds may also be in a protective state. Upon detection of a threatening condition, such as detection of a gunshot or a flying projectile, blinds that are in an open state will be transitioned into a closed, protective state to protect against ballistic projectiles or other threatening materials.

While ample embodiments have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the disclosed embodiments.

What is claimed is:

1. A blind system comprising:

a suspended blind configured to hang in an interior window frame of a structure, said blind being attached at a top of the window frame and comprising a plurality of rotatable horizontally arranged slats having a light-weight, non-metallic anti-ballistic material configured to have a uniform thickness, said blind being configured to have a retracted state with the slats collapsed toward the top of the window frame allowing light to be transmitted through the window frame, said blind being further configured, when not in said retracted state, to rotate said slats to transmit light in an open state, said blind also being configured to have a protective state with the blind not in the retracted state and with the slats rotated to block light with the blind deploying in the window frame to activate anti-ballistic properties to stop projectiles from entering an interior of the structure;

a control system operably configured to cause a change in state of the blind from the retracted or open state to the protective state; and a sensing system operably configured to automatically detect a threatening event occurring outside of said structure, wherein the sensing system, upon sensing the threatening event, automatically triggers the control system transition to the protective state.

2. A blind system according to claim 1, wherein the blind in the protective state prevents or repels entry or unauthorized intrusion.

3. A blind system according to claim 1, wherein the blind is comprised of a plurality of slats comprising a non-metallic light-weight material with anti-ballistic properties that can be rotated to put the blinds in the open state and which can be further rotated to close the blinds to put the blinds into the protective state.

4. A blind system according to claim 3, wherein the slats inter-lock when the blind is in the protective state.

5. A blind system according to claim 1, further wherein the blind is made of fire-resistant material configured such that the blinds prevent the spread of fire when the blinds are in the protective state.

6. A blind system according to claim 1, wherein the sensing system includes an infrared motion sensor, a microwave sensor, vibration sensors, and/or a video sensor.

7. A blind system according to claim 1, further comprising a warning device in communication with the sensing system and operable to warn a user of an unauthorized intrusion.

8. A blind system according to claim 1, wherein the warning device may be given as a verbal command, a text message to a mobile device or email.

9. The blind system according to claim 1, wherein said blinds comprise a plurality of slats comprising a ballistic resistant material including Kevlar, Lexan, tensylon, and/or a boron treated material.

10. The blind system of claim 1, wherein each one of said slats is comprised of a fabric that is configured with anti-bullet properties.

11. A blind system comprising:

a blind including a plurality of rotatable slats of uniform thickness horizontally arranged and each including a non-metallic light-weight material with anti-ballistic properties;

a control system operably configured to cause a change in state of the blind from an open state to a protective closed state; and a sensing system operably configured to detect a threatening event, wherein the sensing system upon sensing the threatening event triggers the control system to transition from the open state to the protective state such that in the protective state, the blinds are adapted to be resistant to penetration by high-speed ballistic objects.

12. A blind system according to claim 11, wherein the blind is confined between two glass panes.

13. A blind system according to claim 12, wherein the glass panes have a layer of safety film between 4 mil to 10 mil of thickness.

14. A blind system according to claim 12, wherein the glass panes are a fire glass with a gel filled center configured to protect against fire and prevent the spread of fire.

15. A blind system according to claim 11, wherein the blinds in the protective closed state leaves a small port hole for the user to utilize for visibility allowing the user to see out of the small port.

16. The blind system of claim 11, wherein each one of said slats is comprised of a fabric that is configured with anti-bullet properties.

17. A blind system comprising:

a rail;

a blind suspended from the rail, wherein said blind includes a plurality of rotatable slats each including a non-metallic light-weight fabric material with anti-ballistic properties; and a blind adjustment system that is configured to transition the blinds from an open state to a closed, protective state in which the blinds are adapted to be resistant to penetration by high-speed ballistic objects.

18. The blind system according to claim 17, wherein the slats include a groove and a tongue configured to interlock the slats in the protective state.

19. A blind system according to claim 17, further comprising of a control system operably configured to cause a change in state of the blind from an open state to a protective closed state.

20. A blind system according to claim 17, wherein the ballistic material includes Kevlar, Lexan tensylon, boron, steel, and/or a composite of materials.

21. The blind system of claim 17, wherein each one of said slats is comprised of a fabric that is configured with anti-bullet properties.

22. A blind system comprising:

a rail configured to place in a window frame of a window of an interior;

a blind suspended from the rail, wherein said blind includes a plurality of horizontally arranged rotatable slats of uniform thickness having a non-metallic ballistic resistant material;

a blind adjustment system that is configured to transition the blinds from an open state with the slats oriented in a manner to permit light to flow through the slats from the window into the interior, to a protective state in which the slats are rotated into a closed, protective position adapted to be resistant to penetration by high-speed ballistic objects through the blind; and another blind adjustment system which raises and lowers the blinds.

23. The blind system of claim 22, wherein each one of said slats is comprised of a fabric that is configured with anti-bullet properties.

24. A blind system comprising:

a mounting structure provided near a top of a window frame;

a blind configured to hang in a window frame from the mounting structure by suspension and comprising a fabric comprised of a light-weight anti-ballistic material, said blind being configured to have a retracted state allowing light to be transmitted through the window frame, and a protective state with the blind dropping into the window frame for protecting an interior of said structure from penetration by a projectile through the window; and an actuator configured to cause a change in state of the blind from the retracted state to the protective state.

25. The blind system of claim 24, further comprising a sensing system operably configured to automatically detect a threatening event, wherein the sensing system, upon sensing the threatening event, automatically triggers the actuator to transition the blind to the protective state.

26. The blind system of claim 24, wherein the actuator includes a switch for activation by a user for transitioning the blind to the protective state.

* * * * *